United States Patent [19]

Taylor

[11] 4,014,060

[45] Mar. 29, 1977

[54] SHOE SOLE CLEANER

[76] Inventor: Wallace N. Taylor, P.O. Box 824, Dothan, Ala. 36301

[22] Filed: Dec. 4, 1975

[21] Appl. No.: 637,722

[52] U.S. Cl. ..... 15/36

[51] Int. Cl.[2] ..... A47L 23/22

[58] Field of Search ..... 15/36, 310, 311, 37

[56] References Cited

UNITED STATES PATENTS

| | | | |
|---|---|---|---|
| 823,972 | 6/1906 | Richardson | 15/36 |
| 1,359,193 | 11/1920 | Parker | 15/311 |
| 3,048,867 | 8/1962 | Counts | 15/36 |
| 3,228,052 | 1/1966 | Kuz | 15/36 |

FOREIGN PATENTS OR APPLICATIONS

| | | | |
|---|---|---|---|
| 1,168,873 | 9/1958 | France | 15/36 |
| 1,111,058 | 10/1955 | France | 15/36 |
| 54,222 | 2/1948 | France | 15/311 |
| 613,979 | 9/1926 | France | 15/36 |
| 732,715 | 6/1955 | United Kingdom | 15/36 |

*Primary Examiner*—Christopher K. Moore
*Attorney, Agent, or Firm*—Clarence A. O'Brien; Harvey B. Jacobson

[57] ABSTRACT

A support structure is provided for recessing below the upper surface of a floor or walk and an elongated horizontal grill is mounted from the support structure and includes a plurality of elongated horizontally laterally spaced apart grill members spaced longitudinally along and extending transversely of the grill. The grill members are free of interconnecting structure throughout substantial portions of their length aligned longitudinally of the grill and a pair of parallel rollers are journaled from the support structure and spaced beneath the grill with the rollers extending longitudinally of the grill and transversely of the grill members. A wide endless flexible belt is trained about the rollers and includes outwardly projecting bristles projectable upwardly through the generally vertical slots defined between adjacent grill members. A motor is supported from the support structure and drivingly connected to one of the rollers whereby the belt may be orbited about the rollers. One marginal portion of the grill is supported from the support structure for vertical shifting relative thereto and the motor includes an actuating control responsive to weight, in addition to the weight of the grill, urging the aforementioned one marginal edge portion of the grill downwardly. Further, one end of the grill is bridged by an inverted U-shaped handle and a cover panel is hingedly supported from the same end of the grill and is swingable between an operative position overlying the grill and a raised inoperative position received between the legs of the inverted U-shaped handle.

7 Claims, 6 Drawing Figures

SHOE SOLE CLEANER

BACKGROUND OF THE INVENTION

Various forms of floor surface recessed boot and shoe cleaning apparatuses have been heretofore designed such as those disclosed in U.S. Pat. Nos. 823,972, 1,019,769, 1,277,834, 1,404,759, 1,567,832 and 3,482,272.

However, these previous boot and shoe cleaning devices have not been constructed in a manner so as to afford ease and thoroughness of boot and shoe cleaning, ease of maintenance and service, safety in use and safety and preventive maintenance when not in use in a single boot and shoe cleaning apparatus.

BREIF DESCRIPTION OF THE INVENTION

The boot and shoe cleaner of the instant invention includes structural features enabling both boots or shoes of an individual to be thoroughly cleaned at one time. In addition, the cleaner is provided with features which enable easy maintenance and cleaning of the boot and shoe cleaner. Still further, the boot and shoe cleaner includes a hinged cover whereby the boot and shoe supporting grill of the cleaner may be covered when the cleaner is not in use so as to avoid a possible safety hazard and the cleaner is also provided with an upwardly projecting handle to be grasped by the user of the shoe cleaner thereby lending confidence of a user of the shoe cleaner at least upon initial use thereof as to the safe manner in which the shoe cleaner may be used. Still further, the cover panel of the cleaner is swingable, when in an open position, to a position supported from the aforementioned upwardly projecting handle. In this manner, an extremely effective shoe cleaner is provided which tends to instill confidence in the user thereof and which may be rendered inoperative whenever desired by the closing of a closure panel to thereby reduce the possibility of the boot and shoe supportive grill of the cleaner constituting a possible safety hazard when the cleaner is not in use.

The main object of this invention is to provide a shoe and boot cleaner which will be capable of cleaning the soles of the boots and shoes of persons standing upon a supportive grill portion of the cleaner.

Another object of this invention is to provide a cleaner which will be automatically actuated upon the weight of a user thereof being supported from the grill portion of the cleaner.

Still another object of this invention is to provide a cleaner in accordance with the immediately preceding objects and including a closure panel which may be swung to a position closely overlying the grill of the cleaner when the latter is not in use.

Another very important object of this invention is to provide an upstanding handle portion for the shoe cleaner which may be grasped by a person using the cleaner in order to instill confidence in that person as to the safety in using the cleaner.

Yet another object of this invention, in accordance with the immediately preceding objects, is to provide a handle from which the cover for the grill of the cleaner may be supported when the cover is in an open position during periods of use of the cleaner.

A final object of this invention to be specifically enumerated herein is to provide a shoe sole cleaner which will conform to conventional forms of manufacture, be of simple construction and easy to use so as to provide a device that will be economical feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
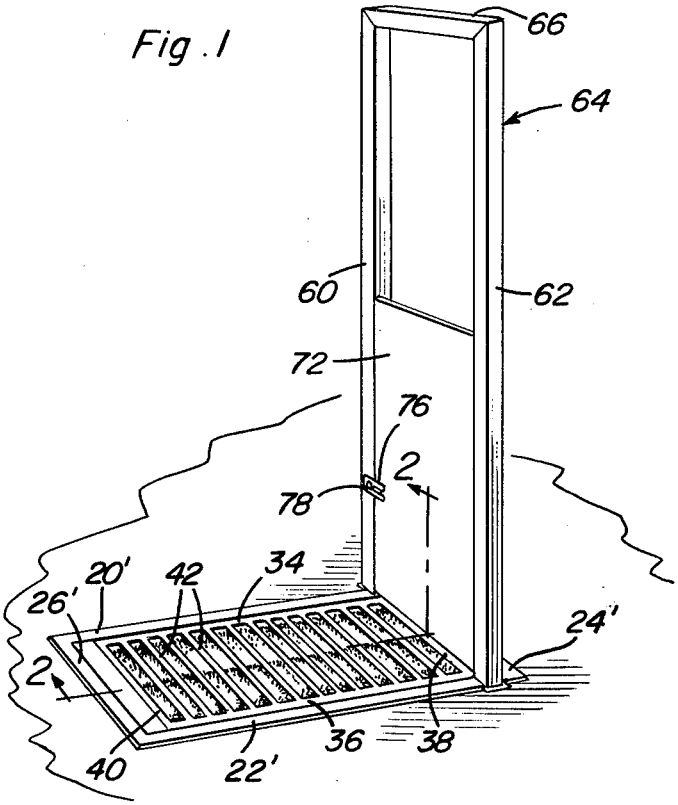
FIG. 1 is a perspective view of the shoe cleaner of the instant invention with the shoe cleaning components thereof recessed in position below a walking surface.
Figure 5:
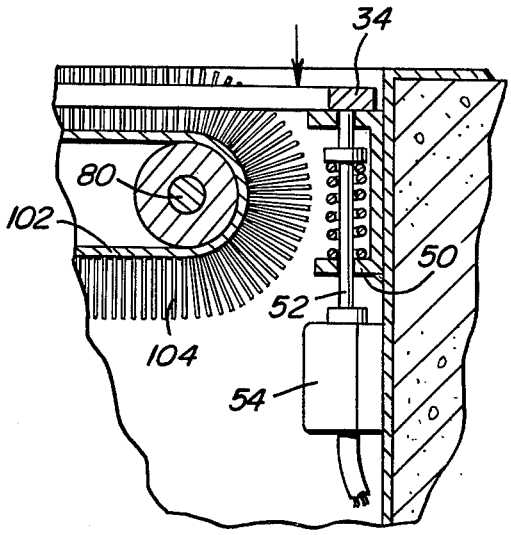
FIG. 5 is a fragmentary enlarged transverse vertical sectional view taken substantially upon the plane indicated by the section line 5—5 of FIG. 4.
Figure 3:
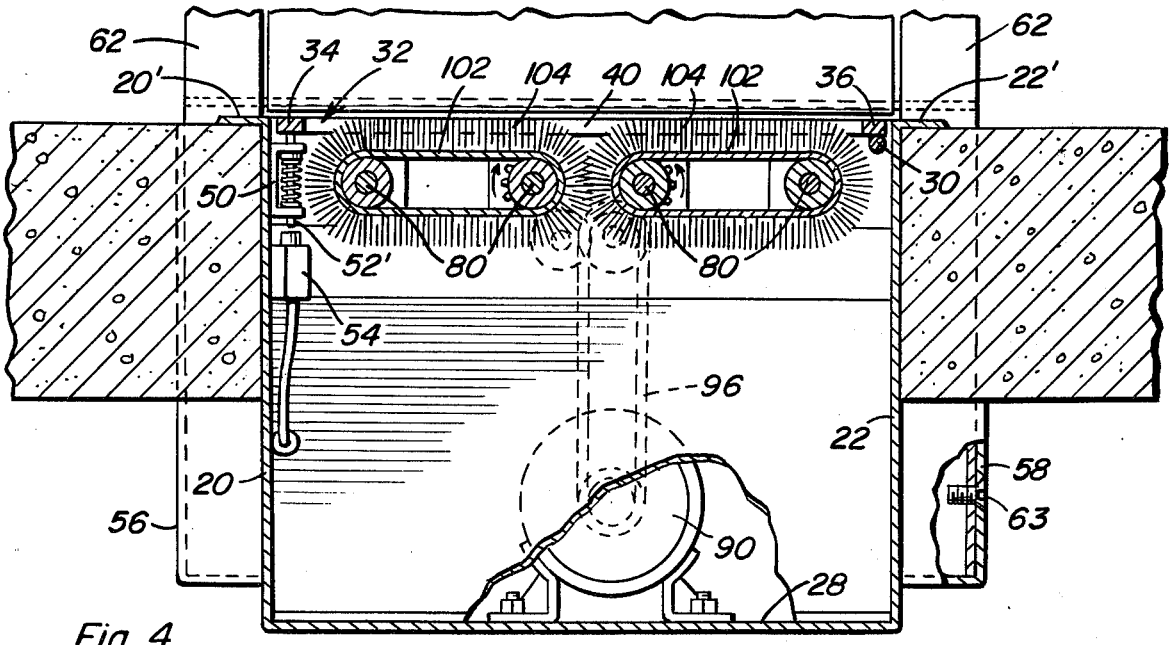
FIG. 3 is a fragmentary transverse vertical sectional view taken substantially upon the plane indicated by the section line 3—3 of FIG. 2.
Figure 4:
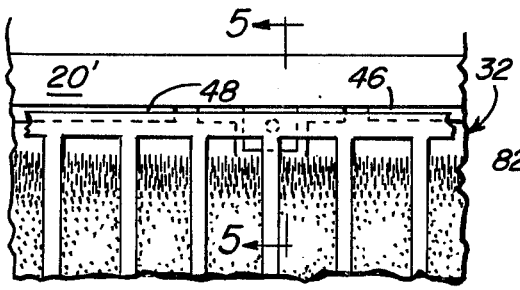
FIG. 4 is a fragmentary top plan view of one marginal edge portion of the shoe cleaner.
Figure 6:
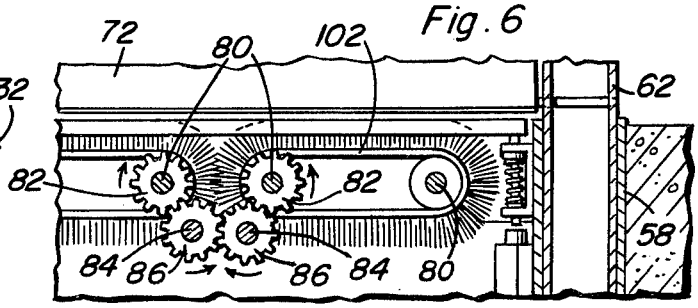
FIG. 6 is a fragmentary transverse vertical secional view taken substantially upon the plane indicated by the section line 6—6 of FIG. 2.

Referring now more specifically to the drawings, the numeral 10 generally designates a support structure including an upper surface 12 which may be walked upon. The structure 10 may comprise a cement walkway, a concrete or cement flooring slab, or any suitable flooring construction. The structure 10 has a vertically extending opening 14 formed therein in which the shoe sole cleaner of the instant invention referred to by the reference 16 is recessed.

The cleaner 16 includes an open top housing referred to in general by the reference numeral 18. The housing 18 includes opposite longitudinal side walls 20 and 22, opposite end walls 24 and 26 and a bottom wall 28 extending between and interconnecting the lower marginal portions of the walls 20, 22, 24 and 26.

The upper marginal portions of the walls 20, 22, 24 and 26 include outwardly directed horizontal flanges 20′, 22′, 24′ and 26′ which overlie the structure 10 and rest upon the surface 12 thereby supporting the housing 18 from the structure 10.

The housing 18 includes an upper longitudinal bar 30 supported therefrom in any convenient manner immediately inwardly of the upper marginal portion of the side wall 22 and extending longitudinally of the housing 18. A grill structure referred to in general by the reference numeral 32 is porvided and is generally rectangular in plan shape including opposite side longitudinal members 34 and 36 as well as opposite end members 38 and 40. The grill additionally includes transversely extending and longitudinally spaced grill members 42 extending and secured between the longitudinal members 34 and 36. The upper surface portions of the grill 32 are generally co-planar with the upper surfaces of the flanges 20′, 22′, and 26′ and accordingly, the grill 32 is only slightly elevated above the upper surface 12 of the structure 10.

The longitudinal member 36 rests upon the bar 30 and the housing 18 includes inwardly projecting longitudinally extending and spaced apart support members 46 and 48 extending along opposite end portions of the upper marginal edge of the side wall 20 for support of the longitudinal member 34 of the grill 32 therefrom. However, a mounting bracket 50 is supported from the side wall 20 intermediate the adjacent ends of the members 46 and 48 and includes a spring biased vertically shiftable pin 52 supported therefrom, the pin 52 being biased upwardly into engagement with the undersurface of the intermediate portion of the longitudinal member 34 and for support of the longitudinal member 34 in slightly elevated position above the supportive members 46 and 48. However when the weight of a person's foot resting upon the grill 32 yieldingly biases the longitudinal member 34 downwardly against the upwardly biasing action of the pin 52, the latter is urged downwardly for closing a normally open electric switch 54 supported from the side wall 20, the purpose for the switch 54 to be hereinafter more fully set forth.

The end of the housing 18 adjacent the transverse member 38 of the grill 32 includes upwardly opening socket members 56 and 58 downwardly into which the lower ends of a pair of parallel legs 60 and 62 of an inverted U-shaped handle referred to in general by the reference numeral 64 are telescoped. The lower ends of the legs 60 and 62 are retained within the socket members 56 and 58 by means of suitable fasteners 63. The handle 64 includes an upper horizonal bight portion 66 extending between and interconnecting the upper ends of the legs 60 and 62 and a partial cover plate 68 extends between the upper ends of the socket member 56 and 58 between the legs 60 and 62 and has one end portion 70 of a closure panel 72 pivotally supported therefrom as at 74 for swinging movement of the closure panel 72 between the raised open position disposed between the legs 60 and 62 illustrated in FIGS. 1 and 2 and a lowered position overlying and extending the full length of the grill 32. The cover panel 72 and the leg 60 including coacting releasably engaged latch components 76 and 78 retaining the cover panel 72 in the open position between the legs 60 and 62.

Two pairs of transversely spaced rollers 80 extending longitudinally of the housing 18 beneath the grill 32 are journaled from the end walls 24 and 26 and the ends of the center rollers 80 adjacent the end wall 24 include gear wheels 82. A pair of idler shafts 84 are journaled from the end wall 24 and have meshed gear wheels 86 mounted thereon meshed with the gear wheels 82 and one of the shafts 84 has a sprocket wheel 88 mounted thereon. An electric motor 90 under the control of the switch 54 includes an output shaft 92 having a sprocket wheel 94 mounted thereon aligned with the sprocket wheel 88 and the sprocket wheel 94 is drivingly connected to the sprocket wheel 88 by means of an endless drive chain 96.

The electric motor 90 is supported from the bottom wall 20 within the end of the housing 18 adjacent the end wall 24 and the gear wheels 82 and 84 and the sprocket wheels 88 and 94 as well as the chain 96 are disposed beneath the cover panel or plate 68 for protection from above. In addition, an inclined baffle 98 extends between the sides 20 and 22 and has its upper end supported closely beneath the ends of the rollers 80 projecting beneath the plates 68. The lower end of the baffle 98 is secured to the remote end of the bottom wall 20 a spaced distance from the end wall 26. In addition, the end of the housing 18 remote from the handle 64 includes a hinged cover plate or door 100 extending thereacross and the cover 100 may be swung to the open phantom-line position thereof illustrated in FIG. 2 of the drawings in order to enable the inlet end of a vacuum wand to be inserted downwarldy into the bottom of the adjacent end of the housing 18 in order to vacuum collected dirt therefrom.

Figure 2:
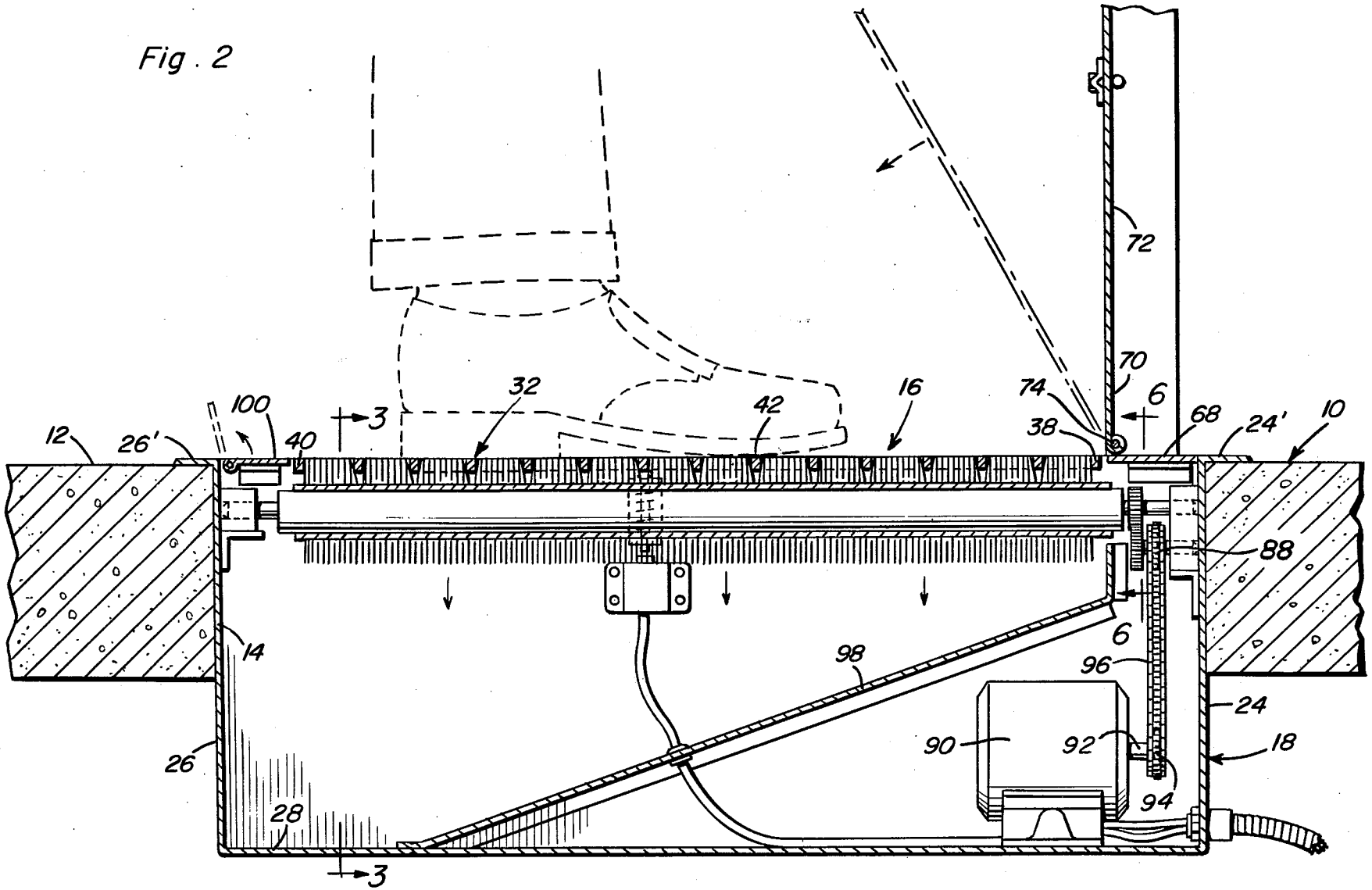
FIG. 2 is an enlarged fragmentary longitudinal vertical sectional view taken substantially upon the plane indicated by the section line 2—2 of FIG. 1.

In operation, when it is desired to use the cleaner 16, the cover panel 72 thereof is raised from a closed position closely overlying the grill 32 and latched in the open position thereof illustrated in FIGS 1 and 2 of the drawings. Then, a person desiring to clean his shoes or boots stands upon the grill 32 with his shoes extending longitudinally of the grill and disposed in vertical registry with the transversely space longitudinal zones of the grill beneath which the pairs of rollers 80 are disposed. The pairs of rollers 80 have wide elongated and flexible endless belts 102 trained thereabout and the belts 102 include outwardly projecting bristles 104 with the bristles supported from the upper reaches of the belts 102 projecting upwardly through slots defined between adjacent grill members 42.

As a person stands on the grill 32, his weight is sufficient to lower the side of the grill defined by the longitudinal member 34 thereof and to cause the pin 52 to be biased downwardly so as to actuate and thereby close the switch 54. Closing of the switch 54 actuates the motor 90 and the latter thus drives the sprocket wheel 80 and the shaft 84 from which the sprocket wheel 88 is supported. Thus, both shafts 84 are driven and the gear wheels 86 supported therefrom drive the gear wheels 82 supported by the center rollers. 80. Accordingly, the upper reaches of the belts 102 move toward the longitudinal center line of the grill 32 and brush the undersole portions of the user's shoes or boots disposed on the grill 32 in order to remove dirt therefrom. Dirt which is removed from the soles positioned upon the grill 32 moves toward the center of the cleaner 16 and then is directed downwardly between the adjacent portions of the belts 102 toward the partition or baffle 98 whereupon the dirt striking the baffle 98 will slide downwardly therealong toward the bottom of the end of the housing 18 remote from the motor 90. After dirt has been collected within the bottom of the end of the housing disposed beneath the cover panel 100 for an indeterminate period, the cover panel 100 may be opened and the inlet end of a vacuum wand may be inserted downwardly into the interior of the housing in order to vacuum the collected dirt therefrom.

Of course, after the user's shoe or boot soles have been cleaned and he steps from the grill 32, the spring biased pin 52 upwardly displaces the corresponding side of the grill 32 and thus enables the normally open switch 54 to return to its open position in order to terminate operation of the motor 90. If the shoe cleaner 16 is not to be used in the near future, the cover panel 72 may be released from its open position between the legs 60 and 62 and swung downwardly so as to closely overlie the grill 32.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A shoe sole cleaner comprising a support structure, an elongated horizontal grill mounted from said support structure, said grill including a plurality of elongated horizontally laterally spaced apart grill members extending transversely of said grill and free of interconnecting means throughout substantial portions of their length , a pair of parallel rollers journaled from said support structure, spaced beneath said grill and extending longitudinally of said grill, a wide endless flexible belt trained about said rollers and including outwardly projecting bristles, the bristles on the upper reach of said belt projecting upwardly between adjacent grill members of said grill, and motor means drivingly connected to one of said rollers, an upstanding position retainer supported adjacent one marginal edge portion of said grill, a cover panel having one marginal edge pivotally supported adjacent said one marginal edge portion for swinging of said cover panel between a first horizontal position closely overlying said grill and a second upstanding position at least closely adjacent said position retainer, said cover panel and said position retainer including coacting latch means releasably retaining said cover panel in said second position.

2. The combination of claim 1 wherein said support structure includes an upwardly opening housing of generally rectangular plan shape, said rollers extending longitudinally of said housing.

3. The combination of claim 2 wherein said housing includes an internal transverse baffle inclined downwardly toward one end of said housing the end of said housing downwardly toward which said baffle is inclined including means defining a transverse access slot downwardly through which the inlet end of a vacuum wand may be injected for vacuuming accumulated dirt from the bottom of said housing.

4. The combination of claim 1 wherein one marginal edge portion of said grill is yieldingly supported from said support structure, and controlling switch means for said motor operatingly associated with said one marginal edge portion for actuation of said motor means in response depression of said one marginal edge portion.

5. In combination, a shoe sole cleaner including a support grill, motorized brush means supported beneath said grill including bristles projecting upwardly through said grill, an inverted U-shaped position retainer supported adjacent one marginal edge portion of said grill, a cover panel having one marginal edge pivotally supported adjacent said one marginal edge portion for swinging of said cover panel between a first horizontal position closely overlying said grill and a second upstanding position at least closely adjacent said position retainer, said cover panel and said position retainer including coacting latch means releasably retaining said cover panel in said second position.

6. The combination of claim 5 wherein said position retainer includes a pair of upstanding legs interconnected at their upper ends by means of a bight portion extending therebetween, said cover panel, when in said second upstanding position being received between said legs beneath said bight portion.

7. In combination, a shoe sole cleaner including a support grill, motorized brush means supported beneath said grill including bristles projecting upwardly through said grill, a position retainer supported adjacent one marginal edge portion of said grill, a cover panel having one marginal edge pivotally supported adjacent said one marginal edge portion for swinging of said cover panel between a first horizontal position closely overlying said grill and a second upstanding position at least closely adjacent said position retainer, said cover panel and said position retainer including coacting latch means releasably retaining said cover panel in said second position.

* * * * *